US007476145B2

(12) United States Patent
Marquardt et al.

(10) Patent No.: US 7,476,145 B2
(45) Date of Patent: Jan. 13, 2009

(54) METHOD FOR PRODUCING A MIRROR FROM A TITANIUM-BASED MATERIAL, AND A MIRROR MADE FROM SUCH A MATERIAL

(75) Inventors: Hans-Georg Marquardt, Uhldingen-Mühlhofen (DE); Klaus-Dieter Knapp, Überlingen (DE); Alfred Gaiser, Überlingen (DE); Peter Gerd Fisch, Überlingen (DE); Anton Dittler, Überlingen (DE); Dirk Bross, Überlingen (DE); Thomas Betz, Überlingen (DE); Jörg Baumgart, Salem (DE)

(73) Assignee: Diehl BGT Defence GmbH & Co. KG, Überlingen (DE)

( * ) Notice: Subject to any disclaimer, the term of this patent is extended or adjusted under 35 U.S.C. 154(b) by 237 days.

(21) Appl. No.: 11/233,425

(22) Filed: Sep. 22, 2005

(65) Prior Publication Data

US 2006/0063474 A1 Mar. 23, 2006

(30) Foreign Application Priority Data

Sep. 22, 2004 (DE) ..... 10 2004 045 883

(51) Int. Cl.
*G02B 5/10* (2006.01)
*B24B 1/00* (2006.01)

(52) U.S. Cl. ..... 451/37; 359/839; 359/867; 359/869; 428/687; 451/41; 451/57; 451/59

(58) Field of Classification Search ..... 359/839, 359/867, 868, 869; 428/687; 451/36, 37, 451/41, 57, 59
See application file for complete search history.

(56) References Cited

U.S. PATENT DOCUMENTS

| | | | | |
|---|---|---|---|---|
| 3,486,274 | A * | 12/1969 | David | 451/290 |
| 5,136,819 | A | 8/1992 | Takagi et al. | |
| 5,478,657 | A * | 12/1995 | Suenaga et al. | 428/612 |
| 6,123,603 | A * | 9/2000 | Tada et al. | 451/37 |
| 6,196,688 | B1 * | 3/2001 | Caskey et al. | 359/603 |
| 6,562,471 | B1 * | 5/2003 | Martin et al. | 428/457 |
| 6,841,265 | B2 * | 1/2005 | Kurisu et al. | 428/687 |
| 6,848,797 | B1 * | 2/2005 | Gillich et al. | 359/883 |
| 6,877,869 | B2 * | 4/2005 | Exel et al. | 359/845 |
| 6,884,361 | B2 * | 4/2005 | Goldstein | 216/2 |
| 7,080,915 | B2 * | 7/2006 | Tsuno et al. | 359/883 |
| 7,242,748 | B2 * | 7/2007 | Loewen et al. | 378/119 |
| 7,273,693 | B2 * | 9/2007 | Nikkel et al. | 430/321 |
| 2003/0057178 | A1 * | 3/2003 | Goldstein | 216/2 |
| 2006/0012881 | A1 * | 1/2006 | Mearini et al. | 359/580 |
| 2006/0285213 | A1 * | 12/2006 | Kanda et al. | 359/619 |

FOREIGN PATENT DOCUMENTS

| | | |
|---|---|---|
| DE | 37 90 008 T1 | 3/1988 |
| EP | 1 256 832 A2 | 4/2002 |

* cited by examiner

*Primary Examiner*—Timothy V Eley
(74) *Attorney, Agent, or Firm*—Scully, Scott, Murphy & Presser, P.C.

(57) ABSTRACT

A method for producing a mirror (10) from a titanium-based material by using the technique of ultraprecision machining. The mirror produced using this method has both a shape accuracy and a surface roughness in the submicrometer region. The mirror (10) is made from a titanium-based material having a shape accuracy and a surface roughness in the submicrometer region, whose basic shape (11) has a has a reflecting surface (12) having a surface roughness of less than 60 nm, and in particular of less than 30 nm.

11 Claims, 3 Drawing Sheets

METHOD FOR PRODUCING A MIRROR FROM A TITANIUM-BASED MATERIAL, AND A MIRROR MADE FROM SUCH A MATERIAL

BACKGROUND OF THE INVENTION

1. Field of the Invention

The invention relates to a method for producing a mirror from a titanium-based material having a shape accuracy and having a surface roughness in the submicrometer region by using the techniciue of ultraprecision machining.

2. Discussion of the Prior Art

A method for machining surfaces based on the material of titanium was advanced in the form of a poster presentation by Z. Tanaka et al. at the $10^{th}$ World Conference on Titanium, Ti-2003, Hamburg. A reflecting surface having a flatness in the region between 700-900 nm and a surface roughness between 60-70 nm is produced with the aid of this method by ultraprecision grinding with a diamond disc on a plane surface.

Titanium-based materials are materials of great hardness that are wear-resistant and extremely insensitive to atmospheric influences. These materials count among the light metals and are therefore principally suited for mirrors in homing heads for guided missiles. However, mirrors with a plane surface do not generally exhibit the properties with reference to the optical beam path which are required in homing heads. A basic shape for a mirror in a homing head is described, for example, in EP 1 256 832 A2. It is possible by means of this basic shape to focus the radiation impinging on the mirror and to implement a prescribed beam path. Since such applications require a high image quality, radiation incident on the mirror must be reflected particularly effectively.

It is disadvantageous that only mirrors with a plane surface and no reflecting surfaces with stringent requirements placed on reflectivity can be produced from a titanium-based material using the method described in the abovenamed prior art.

SUMMARY OF THE INVENTION

The present invention is based on the technical problem of specifying a method for producing a mirror from a titanium-based material with the aid of which it is possible to fabricate mirrors of any desired basic shape which have a further improved reflectivity by comparison with the prior art in conjunction with a shape accuracy and a surface roughness in the submicrometre region. The present invention is also based on the object of specifying a mirror made from a titanium-based material having a shape accuracy and a surface roughness in the submicrometre region, but having a reflectivity of its reflecting surface which is improved by comparison with the prior art.

According to the invention, the first-named object is achieved by virtue of the fact that the technique of ultraprecision machining is used to fashion a basic shape from the material, and for the purpose of further reducing the surface roughness and of producing a reflecting surface this basic shape is then polished with a polishing body that has a lesser hardness than the material, this being done in such a way that the shape accuracy is retained.

A mirror is understood in the sense of the application as an optical instrument at whose surface electromagnetic radiation is reflected as completely as possible so as to produce an image dependent on the shape of the mirror.

Ultraprecision machining is understood in the sense of the application as methods such as turning, milling, boring and grinding which cut in the micrometre region and are mostly executed on machines guided on air bearings with the aid of high-accuracy shaping tools such as, in particular, monocrystalline diamond tools.

Surface roughness in the sense of the application is understood as the root mean square roughness in accordance with ISO 4287.

In a first step, the invention proceeds from the consideration that the surface roughness, also termed depth of roughness below, must be slight so that regular, directional reflection, and not diffuse reflection, takes place at a mirror. Depths of roughness of the order of magnitude of the incident radiation wavelength have the effect that the reflecting surface produces diffusion by back scattering in many directions. By contrast, the incident radiation is reflected when the depth of roughness is small by comparison with the radiation wavelength. A surface roughness in the region between 30-50 nm is required for a high-quality infrared mirror (IR mirror) which is intended to have a high reflectivity of above 97% in a spectral region between 3-7 μm, such as is used in homing heads, for example. Only such a mirror is capable of virtually completely reflecting the incident radiation within this region of radiation wavelength.

In a further step, the invention proceeds from the finding that basic shapes with deviations from the desired shape of less than 1 μm can be produced using the methods of ultraprecision machining such as ultraprecision turning, ultraprecision milling, ultraprecision boring and ultraprecision grinding. The production of a prescribed basic shape is necessary to implement complex optical systems with a prescribed beam path such as, for example, in homing heads of guided missiles. Both the quality of an image from an object which is produced and the position of the image plane of a mirror depend on the basic shape of the mirror. A shape accuracy in the submicrometre region is required for sensitive applications such as, for example, those in which an optical system downstream of the mirror is aligned with the position of the latter's image plane.

The invention now proceeds from the finding that—by contrast with the materials which are customarily subjected to ultraprecision machining, such as cubic face-centred aluminium or copper—titanium-based materials exhibit two different crystal microstructures, specifically hexagonal α and cubic body-centred β. These two crystal microstructures have different binding energies, and therefore different mechanical properties such as elasticity and strength. Consequently, during the ultraprecision machining material is removed with varying intensity depending on which crystal microstructure is present at which sites on the surface, and the ultraprecision tool is subjected to varying wear. Because of the different crystal microstructure present at the surface, during the further surface machining by means of ultraprecision tools, in particular when machining is performed with an ultraprecision grinding disc, the result is merely a sliding of the crystal planes, that is to say a smearing of the surface of the workpiece and a sticking of the tool, it being impossible to achieve a further improvement in the depth of roughness, that is to say the reduction of the surface roughness or increasing of the reflectivity, by means of ultraprecision machining.

In a last step, the invention proceeds from the consideration that, in contrast to the cutting method of ultraprecision machining, during polishing no material removal takes place, but only the last instances of unevenness are removed. No parts of the workpiece to be machined are broken away or torn off thereby. However, the smoothing movement of the polishing leads to a reduction in the depth of roughness, specifically when using a polishing body of lesser hardness by comparison with the workpiece.

By combining the two methods of material machining, specifically ultraprecision machining and polishing with a polishing body which has a lesser hardness than the material to be machined, it is also possible to implement high-quality metal mirrors which are made from wear-resistant titanium-based material of great hardness and which likewise fulfil the optical requirements placed on reflecting elements of this type, such as good shape accuracy and slight surface roughness.

In a first method step, a titanium-based material is subjected to ultraprecision machining in order to fashion from the workpiece a basic shape that deviates from a prescribed desired shape by less than 1 μm, at best even by less than 500 nm. In a method step following thereupon, the basic shape thus produced is polished in order thereby to produce a reflecting surface of high quality. Use is made in this process of a polishing body—also termed polishing tool—which has a lesser hardness than the material. It is thereby ensured that, firstly, the shape accuracy is retained and, secondly, a reduction in the surface roughness to the extent that a reflecting surface with a reflectivity of above 97% is produced. A high-quality mirror fabricated using this method and made from a titanium-based material opens up new fields of application in which stringent requirements relating to corrosion and wear resistance are placed on the mirror, in addition to its high reflectivity.

Before the actual basic shape is fashioned from the workpiece by means of ultraprecision machining, in addition to the ultraprecision machining it is possible to apply other, coarser machining methods customary in metal machining in order to undertake a first geometrical approximation to the basic shape to be implemented.

The specified method is particularly suitable for producing mirrors with a spherical or aspheric basic shape. Mirrors shaped in such a way and which are used, for example, in a homing head of guided missiles are used to pass on the radiation reflected or emitted by an object, which is mostly in the infrared wavelength region, to appropriate detectors inside the homing head via further optical elements. In order to be able to detect objects by means of the optical system of the homing head, the mirror must, however, be of extremely precise shape, that is to say be affected only by error tolerances in the submicrometre region, such that the image plane is located relatively accurately at the location prescribed by the desired shape. This is required because the optical system downstream of the mirror is adjusted to the desired position of its image plane. It is also conceivable in general to use the described method to produce any desired surface shapes.

During polishing the polishing body is advantageously wiped over the basic shape. During wiping, only a minimum pressure is exerted on the surface to be machined, specifically in such a way as to prevent removing material in a fashion which impairs the accuracy of the basic shape. The slight pressure also prevents the crystal planes from sliding, something which would increase the surface roughness. Wiping is understood in this case as a movement in which the friction between the polishing body and the material, and thus also the temperature increase resulting therefrom, are kept negligibly small. Chemical reactions between polishing body and material are thereby suppressed. Combustion or smearing of the workpiece surface because of intense heat development during the machining, together with associated crack formation because of surface stress, that is to say impairment of the durability of the material, is thereby avoided.

A surface roughness of less than 60 nm, specifically of less than 30 nm, can result from wiping with the polishing body over the basic shape. The wiping movement removes from the surface the last instances of unevenness which originate from the preceding ultraprecision machining. This produces a reflecting surface which satisfies even infrared optical requirements in a spectral region between 3-7 μm with regard to roughness, that is to say which permits the achievement of specular reflectivities of above 97%. Removal of the tool traces occurs owing to the fact that a wiping movement is not a directional movement, but that during the wiping operation there is a continuous change in direction between polishing body and workpiece or basic shape. Thus, for example, turning-tool marks which originate from the ultraprecision machining are removed without leaving new traces from the polishing body behind in the process. Since overlapping movements between polishing body and basic shape are executed during wiping, there is a uniform and complete smoothing, that is to say reduction of the depth of roughness, on the entire surface of the basic shape.

Substantially the same contact pressure is expediently exerted on each site via the polishing body. This ensures that the complete surface of the basic shape experiences a homogeneous force owing to the polishing body. A distance of the machining traces left over from the ultraprecision machining which is uniform over the entire surface is thereby achieved without thereby causing at some sites a more severe impairment of the shape accuracy than at other sites. No convexity or curvature is produced in the case of a plane mirror. In the case of a spherical or aspheric mirror, the shape accuracy of the basic shape thereof is retained.

The basic shape is advantageously polished by means of a flat, flexible membrane which is adapted to the basic shape and at which the polishing body is arranged. Owing to the uniform way in which the membrane conforms to the surface of the basic shape, something which can take place, for example, through applying a pressure of the order of magnitude of the air pressure to the top side of the membrane, a defined contact pressure is exerted on the surface during polishing, and the surface is capable of being machined in a controlled fashion. It can be provided in this case that the membrane is stretched over a hollow cylinder, or that the membrane constitutes the envelope of a balloon filled with liquid. It is conceivable for the thin membrane skin to consist of a flexible material such as rubber.

The polishing is expediently executed in a number of stages having different polishing agents in each case. It can be provided here that a new polishing body is used at the start of each new stage. This prevents any possible contaminants located on the polishing body, or any possible wear phenomena of the polishing body caused by the polishing operation, from leading during polishing to damage to the surface to be machined.

The abrasive action of the polishing agents used, that is to say their grain size distribution, advantageously decreases from stage to stage. The machining traces and instances of surface unevenness or the degree of surface roughness are most strongly pronounced before the first polishing stage, for which reason the polishing body is used here together with a polishing agent having comparatively coarser grain size distribution. It can be necessary, especially during the first polishing stages, to exchange the polishing body several times even within one stage in order to achieve an optimum polishing effect, that is to say a reduction in the surface roughness. This is explained by the fact that the abrasion both of polishing body and of the material is greatest at the start of the polishing, since the instances of surface unevenness of the basic shape are still most strongly pronounced during this phase. It can also be necessary to use fresh polishing agent together with a new polishing body within a stage. During the polishing operation, blunting of the cutting edges of the grains of the polishing agent occurs, and the abrasive action weakens. Although the grains can also break up into smaller grains with fresh cutting edges, after a certain time period dependent on the current roughness of the machined surface, however, no further improvement in the mirror quality is possible any more. The surface roughness decreases with each further polishing stage with a polishing agent of finer graininess. The machining traces left over from the ultraprecision machining can be reduced to such an extent that the surface roughness is reduced at least to the submicrometre region.

It is to be recommended that each stage of the polishing covers a duration of a few minutes. This ensures that all the sites on the surface of the material are polished several times with the polishing body. This reduces the instances of unevenness, caused by the ultraprecision machining, on the entire surface of the basic shape, and produces a reflecting surface of constant quality.

It is conceivable that the polishing, in particular the wiping, is executed manually. During manual polishing by an operator, the latter can skilfully remonitor the surface roughness after any desired times by means of diverse scanning and optical test and measurement methods such as, for example, laser interferometry, AFM (Atomic Force Microscope) recordings and measurements, measurements using the stylus method in accordance with ISO 4287 or the like, and decide as occasioned by the situation whether a change of the polishing body or the polishing agent is to be recommended at this instant.

The polishing body or the polishing tool can be an absorbent material such as a microfibre cloth, a polyurethane pad or a type of nonwoven cloth, for example a paper handkerchief. It is important that the polishing tool has a lesser hardness than the titanium-based material to be machined, since otherwise the polishing body causes additional instances of roughness on the surface of the material.

The titanium-based material is advantageously a titanium/aluminium alloy, in particular with 80 to 90 percent by weight of titanium. Chiefly because of their mechanical and thermal properties, such materials are very well suited for use in aeronautical and aerospace engineering and in missile construction. The titanium alloy TiAl6V4 according to MIL-T-9047 can be involved, for example.

The object directed at the mirror is achieved by means of a mirror of the type mentioned in the beginning which, according to the invention, has a basic shape with a reflecting surface that has a surface roughness of less than 60 nm, in particular of less than 30 nm. Because of its basic shape, such a mirror ensures a defined beam path of the reflected radiation. Owing to the slight depth of roughness of less than 60 nm, the requirements for a high reflectivity for a spectral region between 3-7 μm are also fulfilled.

The mirror is advantageously fabricated from a titanium/aluminium alloy, in particular from TiAl6V4. Because of its high wear resistance, a mirror made from this material can be used particularly effectively in homing head applications for guided missiles.

BRIEF DESCRIPTION OF THE DRAWINGS

An exemplary embodiment of the invention is explained in more detail with the aid of a drawing, in which.

DETAILED DESCRIPTION OF THE INVENTION

Figure 1:
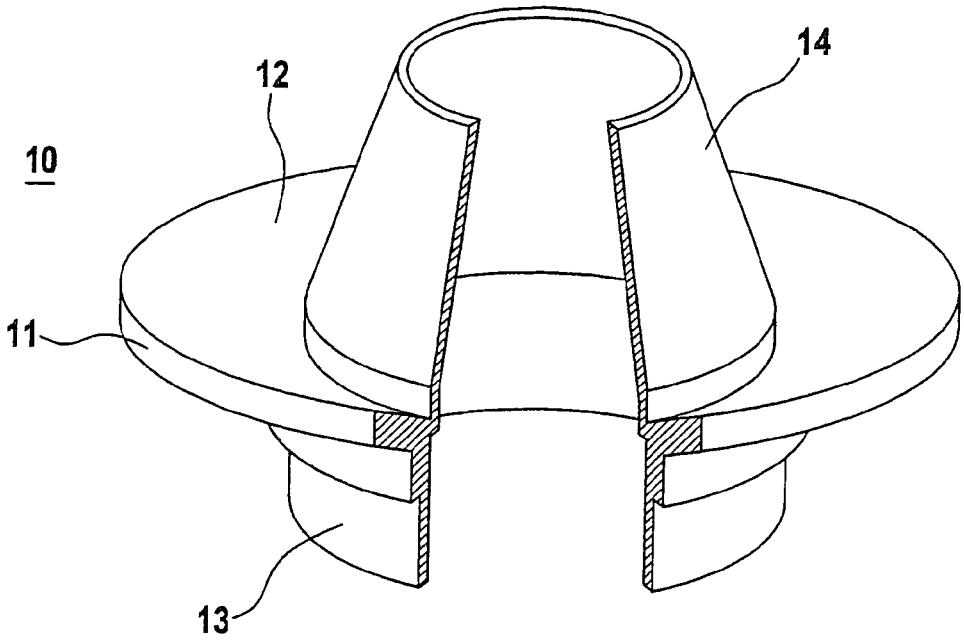
FIG. 1 shows a schematic aspheric mirror for a homing head of a guided missile.

A mirror 10 as used in a homing head of guided missiles is illustrated diagrammatically in FIG. 1. The mirror 10 shown has an aspheric basic shape 11. The titanium alloy with the commercial designation TiAl6V4 according to MIL-T-9047 is used here as material.

The ultraprecision machining is executed on an ultraprecision machine with a 5-axis machining centre of hydrostatic/aerostatic bearing design and with a contactless digitally controlled drive system. This machine system permits a positional accuracy in the submicrometre region. Use is made, inter alia, of an ultraprecision turning machine for producing the basic shape 11 of the mirror 10 according to the figure. The cutting tool consists of monocrystalline diamond. The process of removing titanium-based materials is positively influenced by the very low coefficient of friction and the excellent thermal conductivity of diamond. Combustion of the material surface owing to the evolution of heat arising during the machining process is prevented, since this is effectively dissipated via the diamond cutting tool. The cutting tool has a cutting edge of virtually atomic sharpness. The slight rounding of the cutting edge is enough to ensure the implementation of a slight surface roughness. In addition, only weak processing forces are thereby required during machining, and this results in a moderate evolution of heat and, therefore, in a machining of the material which saves the surface as the basic shape 11 is being produced.

In the exemplary embodiment illustrated, it is not only the plate-like basic shape 11 of the mirror 10 which is fashioned from the workpiece by the ultraprecision machining, but also yet further parts 13, 14 of the homing head, which adjoin the mirror 10. The reflecting surface 12 forms the top side of the plate-like basic shape 11 in this case.

Stylus measurements according to ISO 4287 are carried out in order to determine the surface roughness of a basic shape 11 produced in such a way using the previously described ultraprecision machining. Use is made for this purpose of a stylus instrument from Mahr GmbH with the designation of "Perthometer S3P". Stylus measurements are carried out at various sites on the basic shape 11 over a standard scanning distance of 1.75 mm overall—divided into 5×0.25 mm long individual measurement distances and in each case 0.25 mm at the start and end of a stylus measurement. The waviness is filtered out from the stylus measurements in the case of this stylus instrument. The result of the stylus measurements is that the surface roughness (more precisely, the root mean square roughness) of the basic shape 11 is in the region between 47 and 70 nm or, on average over a number of five stylus measurements, at 57 nm.

The method step of ultraprecision machining is followed by the method step of polishing. In this case, a nonwoven cloth is soaked with a polishing agent based on aluminium oxide and having a graininess of 3 μm. This polishing body is then used to wipe manually over the entire surface on the top side of the basic shape 11, doing so softly for a few minutes while exerting a constant contact pressure. It is ensured in the process that all the sites on the surface which later forms the reflecting surface 12 are polished over the same length of time. Thereafter, the used nonwoven cloth, to which minimal material remnants now adhere, is exchanged for a new nonwoven cloth. This prevents damage owing to scratching of the surface by the material residues in the nonwoven cloth. If necessary, the new nonwoven cloth is used with the same polishing agent, but with a finer graininess in the region of 1-2 μm. The polishing is now repeated in the way previously described. Subsequently, the reflecting surface 12 is once again subjected to stylus measurements in accordance with the way previously described. The stylus measurements at the reflecting surface 12 thus produced demonstrate that the surface roughness (or the root mean square roughness) is in the region between 23 and 26 nm or, when averaged over a number of five measurements, at 24 nm. The result is therefore a reduction in the mean surface roughness by 33 nm or by 58%.

Figure 2:
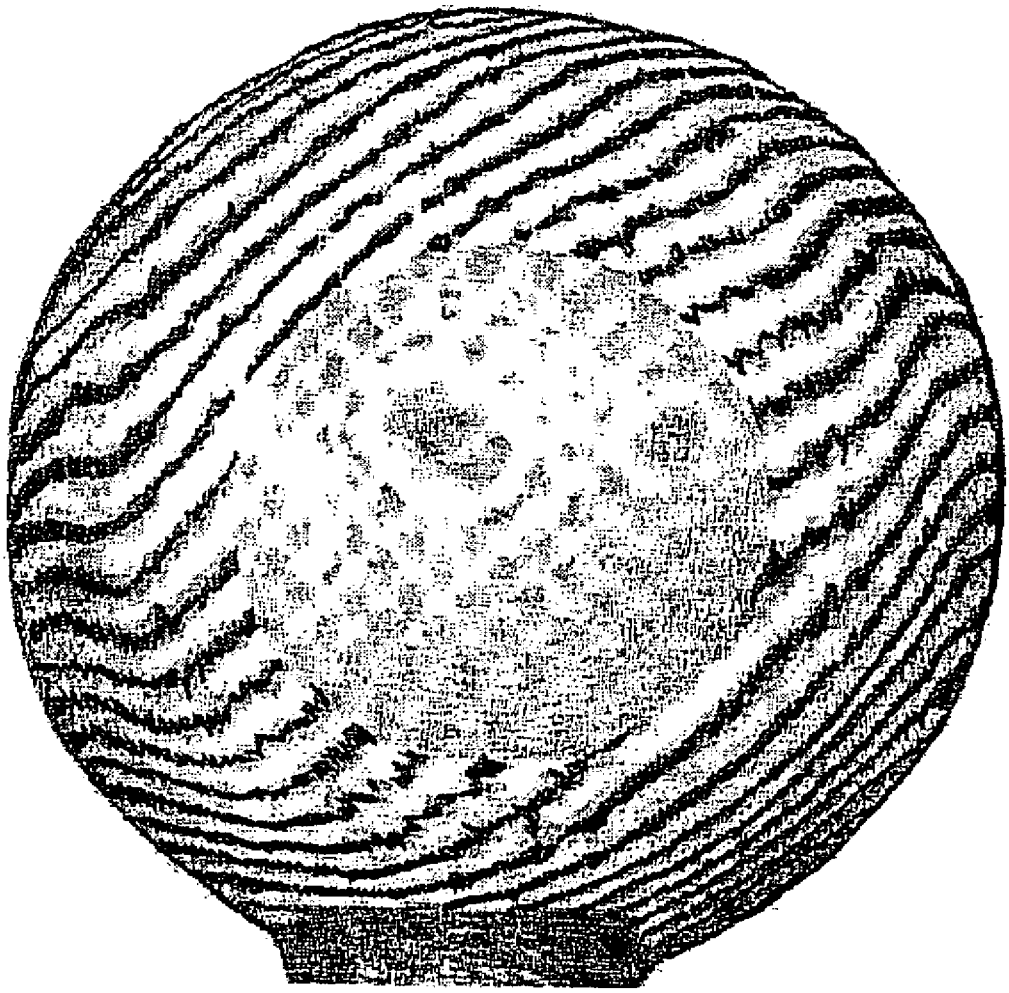
FIG. 2 shows an interferogram of a mirror in accordance with FIG. 1 after ultraprecision machining and subsequent polishing.

FIG. 2 shows an interferogram of the mirror 10 produced in accordance with this method. A Michelson interferometer was used to record the interferogram. The design and mode of operation of a Michelson interferometer are sufficiently well known to the person skilled in the art, and will therefore not be considered in detail here. In this interferogram, a reference mirror was compared with the test object, the mirror 10 or the reflecting surface 12 of the basic shape 11. The wavelength of a helium-neon laser of 632.8 nm was used as measured variable in this case. The reference mirror was arranged slightly tilted by comparison with the mirror 10. A light/dark transition in FIG. 2 corresponds to a difference in the distances of the mirror 10 and of the reference mirror with regard to a reference point of the magnitude of half the wavelength of the helium-neon laser. In an ideal mirror, the contour lines would run parallel to one another between a light/dark transition. Since in the case of the mirror 10 the maximum "sag" of a contour line occurring between a light/dark transition does not exceed the value of twice the distance between two contour lines, it follows therefrom that the maximum shape error of the mirror 10 is smaller than twice half the wavelength of the helium-neon laser, that is to say smaller than 0.6 μm. The mirror 10 therefore exhibits a shape accuracy in the submicrometre region.

Figure 3:
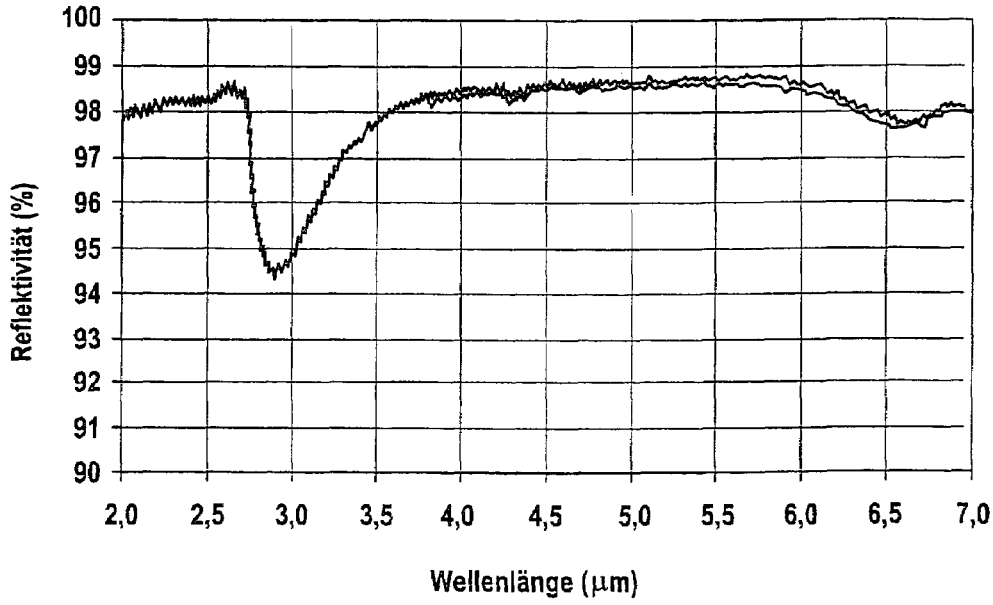
FIG. 3 shows the reflectivity spectra of a mirror in accordance with FIG. 1 after ultraprecision machining and subsequent polishing.

Because of its excellent surface quality, the mirror 10 machined in such a way can be used optimally especially for the infrared spectral region between 3.6 μm and 6.3 μm, as may be gathered from the two reflectivity spectra shown in FIG. 3. The titanium-based mirror 10 produced using this method exhibits a reflectivity of even more than 98% in this spectral region. The high level of quality, which remains constant, of the mirror 10 with regard to the reflectivity of the latter is substantiated by the good agreement between the two reflectivity spectra recorded at different sites on the reflecting surface 12. Marked differences between the two reflectivity spectra are to be noted only in the spectral region between 5.5 and 7 μm.

LIST OF REFERENCE NUMERALS

10 Mirror
11 Basic shape
12 Reflecting surface
13 Part
14 Part

The invention claimed is:

1. Mirror (10) made from solely a titanium-based material having a shape accuracy and having a surface roughness in the submicrometer region, said mirror having a basic shape (11) produced from said titanium-based material with a reflecting surface (12) unitarily produced from said titanium-based material and that has a surface roughness of less than 60 nm, and a specular reflectivity of above 97% within a spectral region of between about 3.25-7 μm, for focusing radiation impinging on said mirror and resultingly implementing a prescribed beam path.

2. Mirror (10) according to claim 1, wherein the material is a titanium/aluminium alloy.

3. Mirror (10) according to claim 1, wherein the reflecting surface (12) has a surface roughness of less than 30 nm.

4. Mirror (10) according to claim 1, wherein a polishing body implements a polishing for said shape accuracy and surface roughness reduction to provide the reflecting surface (12), said polishing body having a lesser hardness than that of the mirror material.

5. Mirror (10) according to claim 4, wherein the polishing body is wiped over the basic shape (11) during polishing of said surface.

6. Mirror (10) according to claim 4, wherein during polishing of the basic shape (11) the polishing body exerts substantially the same contact pressure over the surface thereof.

7. Mirror (10) according to claim 4, wherein said polishing body comprises a flexible structure which is adapted to the basic shape (11), and the polishing body selectively being arranged on a flexible membrane or said membrane being a component of said flexible polishing body.

8. Mirror (10) according to claim 4, wherein the polishing body implements the polishing in a number of stages with different polishing agents in each stage.

9. Mirror (10) according to claim 8, wherein the graininess of the different polishing agents is decreased from stage to stage.

10. Mirror (10) according to claim 1, wherein said reflecting surface (12) has selectively a spherical or aspheric basic shape (11).

11. Mirror (10) according to claim 1, wherein said mirror is arrangeable in a homing head of a guided missile.

* * * * *